US006243925B1

(12) United States Patent
Aszody

(10) Patent No.: US 6,243,925 B1
(45) Date of Patent: Jun. 12, 2001

(54) MULTIPURPOSE HOLDING DEVICE

(76) Inventor: Jozsef Aszody, Csaba U. 32, H-7100 Szekszard (HU)

( * ) Notice: Subject to any disclaimer, the term of this patent is extended or adjusted under 35 U.S.C. 154(b) by 0 days.

(21) Appl. No.: 09/214,633

(22) PCT Filed: Jun. 26, 1997

(86) PCT No.: PCT/EP97/03367

§ 371 Date: Jan. 5, 1999

§ 102(e) Date: Jan. 5, 1999

(87) PCT Pub. No.: WO98/01613

PCT Pub. Date: Jan. 15, 1998

(30) Foreign Application Priority Data

Jul. 5, 1996 (HU) ..... 20628/96

(51) Int. Cl.[7] ..... A44B 21/00; D06F 55/00; D06F 95/00

(52) U.S. Cl. ..... 24/343; 24/7; 24/30.5 S; 24/459; 24/DIG. 29

(58) Field of Search ..... 24/343, 706.1, 24/7, 459, 716, 344, 339, 329, DIG. 29, 30.5 S

(56) References Cited

U.S. PATENT DOCUMENTS

| | | | | |
|---|---|---|---|---|
| 858,989 | * | 7/1907 | Keiser | 24/343 |
| 1,123,231 | * | 1/1915 | Bradley | 24/343 |
| 2,247,372 | * | 7/1941 | Hart | 24/343 |
| 2,794,225 | * | 6/1957 | Price, Sr. | 24/706.1 |
| 3,065,946 | * | 11/1962 | Berkow | 24/343 |
| 5,046,222 | * | 9/1991 | Byers et al. | 24/459 |
| 5,381,588 | * | 1/1995 | Nelson | 24/343 |
| 5,664,709 | * | 9/1997 | Graham | 223/89 |

FOREIGN PATENT DOCUMENTS

| | | | |
|---|---|---|---|
| 43 26 779 | | 9/1994 | (DE) . |
| 2 063 066 | | 6/1981 | (GB) . |
| 0132500 | * | 7/1951 | (SE) ..... 24/459 |

* cited by examiner

*Primary Examiner*—Victor N. Sakran
(74) *Attorney, Agent, or Firm*—Flynn, Thiel, Boutell & Tanis, P.C.

(57) ABSTRACT

A multipurpose holding device, mainly for holding matching garments together, in particular for treating pairs of garments, has a suitable fixing unit (1) for pressing the garments together, the fixing unit having a primary supporting formed piece (2) located on one side of the garments and a secondary supporting formed piece (3) located on the other side of the garments. The primary supporting formed piece (2) includes a limiting member (2*a*) and an opening (2*d*) at least partly framed by the limiting member (2*a*). The secondary supporting formed piece (3) has a free flange (3*a*) which extends into, and preferably through, the opening (2*d*) of the primary supporting formed piece (2). The primary supporting formed piece (2) and the secondary supporting formed piece (3) are interconnected by a connecting neck (4). The connecting neck (4) encloses an acute angle (α, β) with the basal surface (20) of the primary supporting formed piece (2) and/or the basal surface (30) of the secondary supporting formed piece (3). The primary supporting formed piece (2) and/or the secondary supporting formed piece (3) and/or the connecting neck (4) are made of a material capable of elastic deformation.

20 Claims, 2 Drawing Sheets

MULTIPURPOSE HOLDING DEVICE

FIELD OF THE INVENTION

This invention relates to a multipurpose holding device, mainly for temporarily holding together matching garments, in particular for treating pairs of garments. This device is a suitable fixing unit for pressing the garments together, the fixing unit having a primary supporting formed piece located on one side of the garments and a secondary supporting formed piece located on the other side of the garments.

BACKGROUND OF THE INVENTION

With the development of human clothes it has become increasingly complicated to keep them clean. Nowadays it takes considerable time to fold and store the various pairs of garments—e.g. socks, gloves—in a tidy state after cleaning.

For drying the various garments auxiliary devices are known which serve to fasten the garments to a drying device (e.g. a stretched clothesline). They include clothes pins.

A problem with known auxiliary devices for drying garments is that they mostly contain materials prone to corrosion or, because they consist of a plurality of constructional elements, they fall apart or break under strong physical influences, thereby becoming useless. Because of the above-mentioned unfavorable properties these auxiliary devices are unsuitable for holding the textiles together during washing as well.

It is unfavorable that known devices become useless after drying or during storage or can be used only with effort and in complicated fashion.

GB-A-2 063 066 discloses a multipurpose holding device. The primary and secondary formed pieces are located in the basal surface. The secondary supporting formed piece protrudes into the opening of the primary supporting formed piece. In the known multipurpose holding device the clamping effect leaves something to be desired.

SUMMARY OF THE INVENTION

An object of the invention is to eliminate the defects of known auxiliary devices and provide a multipurpose holding device which permits pairs of garments to be held together reliably during washing and thereafter.

The invention is based on the idea of forming a molded part with a certain geometrical shape from an elastic material which firmly holds the various textiles together even in the case of strong external physical influences without the garments being damaged by thus being held together.

This is obtained according to the invention by a holding device—mainly for temporarily holding matching garments together, e.g. for treating paired garments—which has a fixing unit having a primary supporting formed piece on one side of the garments and a secondary supporting formed piece on the other side of the garments. The formation of the pieces is such that the primary supporting formed piece has a limiting member and an opening at least partly framed by the limiting member. The secondary supporting formed piece has a free flange extending into the opening of the primary supporting formed piece, expediently passing therethrough. The primary supporting formed piece and the secondary supporting formed piece are interconnected by a connecting neck. The connecting neck encloses an acute angle with at least one of the holding surfaces of the primary supporting formed piece or the secondary supporting formed piece, and the primary supporting formed piece and/or the secondary supporting formed piece and/or the connecting neck being made of a material capable of elastic deformation.

A further feature of the inventive multipurpose holding device is that the primary supporting formed piece is supplemented by a suspension formed piece.

It is advantageous that the inner connecting surface of the limiting member of the primary supporting formed piece in the direction of the free flange of the secondary supporting formed piece, and/or the outer surface of the limiting member in opposite position to the inner connecting surface, and/or the connecting surface of the free flange of the secondary supporting formed piece in the direction of the opening of the primary supporting formed piece, and/or the pressing surface of the free flange opposite the connecting surface are provided with a friction-increasing rough area.

In another embodiment of the inventive multipurpose holding device, the primary supporting formed piece and/or the secondary supporting formed piece are provided with a marking permitting differentiation. The primary and secondary supporting formed pieces and the connecting neck of the fixing unit are made of an elastic, impact-resistant, non-corrodible material, expediently plastic.

An important advantage of the multipurpose holding device according to the invention is that it consists of a single piece which has corresponding elasticity and which exerts the necessary force for holding the paired garments together without damage even during the cleaning process.

A further advantage is that the holding device is suitable for clearly marking the various garments so that garments of different owners are easy to identify, e.g. after cleaning.

It is advantageous that the holding device does not hinder the cleaning of the clothes, and causes no damage to the textiles during washing.

It is further advantageous that the inventive holding device can be produced with known technology in a simple way and requires no cleaning or maintenance.

BRIEF DESCRIPTION OF THE DRAWINGS

In the following, an embodiment of the invention will be described in more detail with reference to the drawing, in which:

FIGS. 1 and 2 show an expedient embodiment of the inventive holding apparatus. A fixing unit (1) consisting of this invention includes a circular, flat primary supporting formed piece or portion (2) and a circularly-shaped, flat secondary supporting formed piece or portion (3) substantially framed by the primary supporting formed piece (2). A connecting neck (4) interconnects the primary supporting formed piece (2) and the secondary supporting formed piece (3). Neck (4) extends away from a first face of primary supporting formed piece (2).

Connected to the primary supporting formed piece (2) of the fixing unit (1) is the suspension formed piece or portion (6), a hook, which has the function of fastening the holding device to a storing or drying device.

The primary supporting formed piece (2) consists of the limiting member **(2*a*) and the opening (2*d*) defined by the limiting member (2*a*). As evident in particular from FIG. 2, the limiting member (2*a*) has an inner connecting surface (2*b*) and an outer connecting surface (2*c*) which are both provided with friction-increasing rough area (8). The friction-increasing rough area (8) is e.g. the totality of the bulges protruding out of the inner connecting surface (2*b*) and out of the outer surface (2*c*)**.

Figure 2:
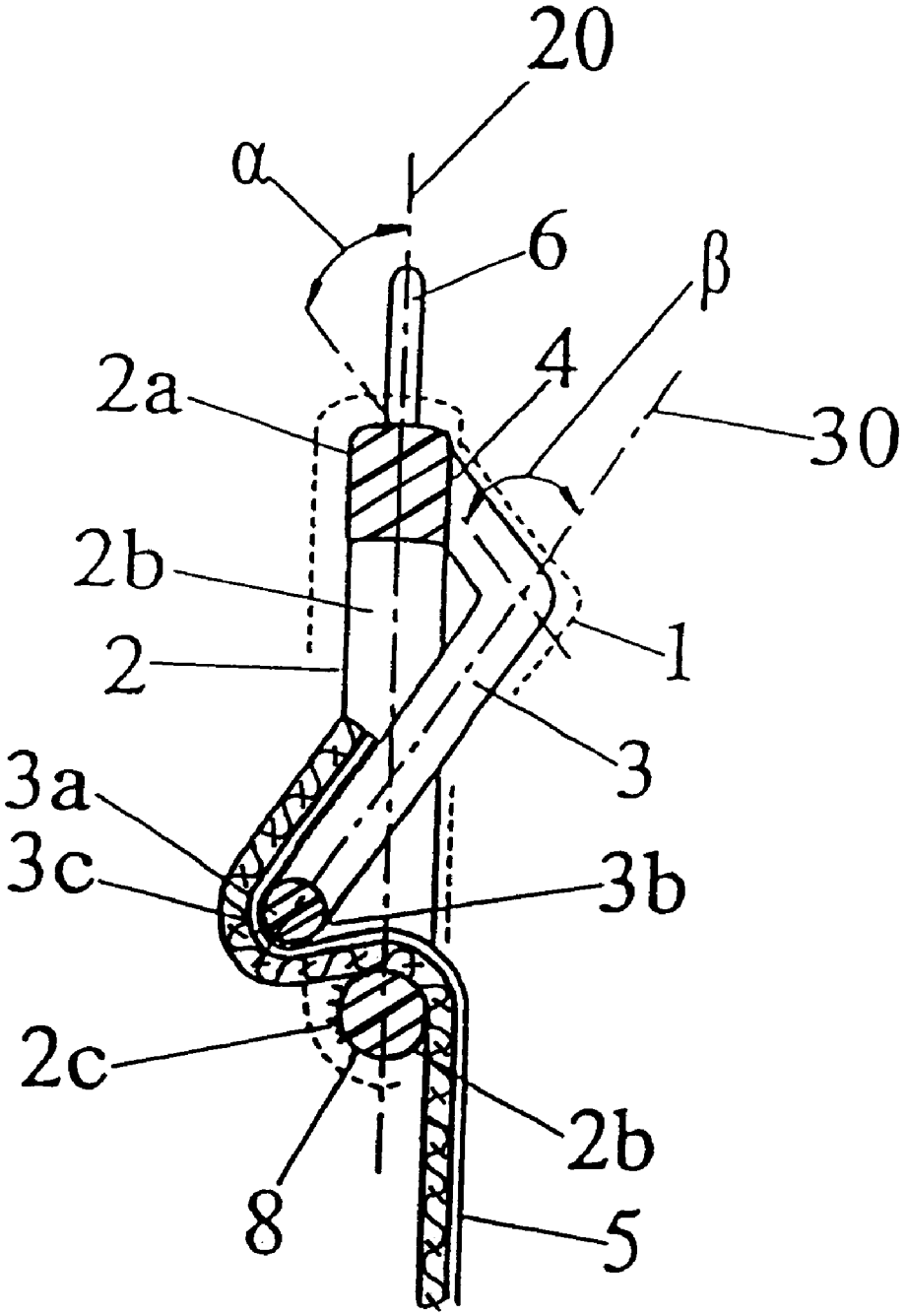
FIG. 2 shows a section along line II—II.

FIG. 2 indicates that the primary supporting formed piece (2) and the secondary supporting formed piece (3) enclose an angle with each other such that the free flange (3*a*) of the secondary supporting formed piece (3) protrudes through the opening (2*d*) of the primary supporting formed piece (2). The free flange (3*a*) of the secondary supporting formed piece (3) has a connecting surface (3*b*) and the pressing surface (3*c*) which also have friction-increasing rough areas. It is further observed that secondary support piece (3) is formed so that its end distal from neck (4) is located entirely within opening (2*d*). Also piece (3) has a rib (3*d*) that extends between the ends of the piece.

FIG. 2 also shows that the connecting neck (4) is at angle $\alpha$ to the plane of the primary supporting formed piece (2) and at angle $\beta$ to the plane of secondary supporting formed piece (3). Both angles $\alpha$and $\beta$ are acute angles. Thus, the end of piece (3) adjacent neck (4) is located adjacent the first face of piece (2). The end of piece (3) distal from the neck (4) is located adjacent a second face of piece (2) that is opposite the first face.

It should be noted that the mutual arrangement of the primary supporting formed piece (2) and the secondary supporting formed piece (3) as well as of the connecting neck (4) according to FIG. 2 is expedient because it permits accordingly strong but nevertheless gentle fastening with the fixing unit (1).

It should also be mentioned that the inventive holding device is expediently made of plastic, such as impact-resistant polystyrene or ABS. The color of the plastic serving as the basic material can vary, which also facilitates classification of the individual paired garments in certain groups after cleaning.

Figure 1:
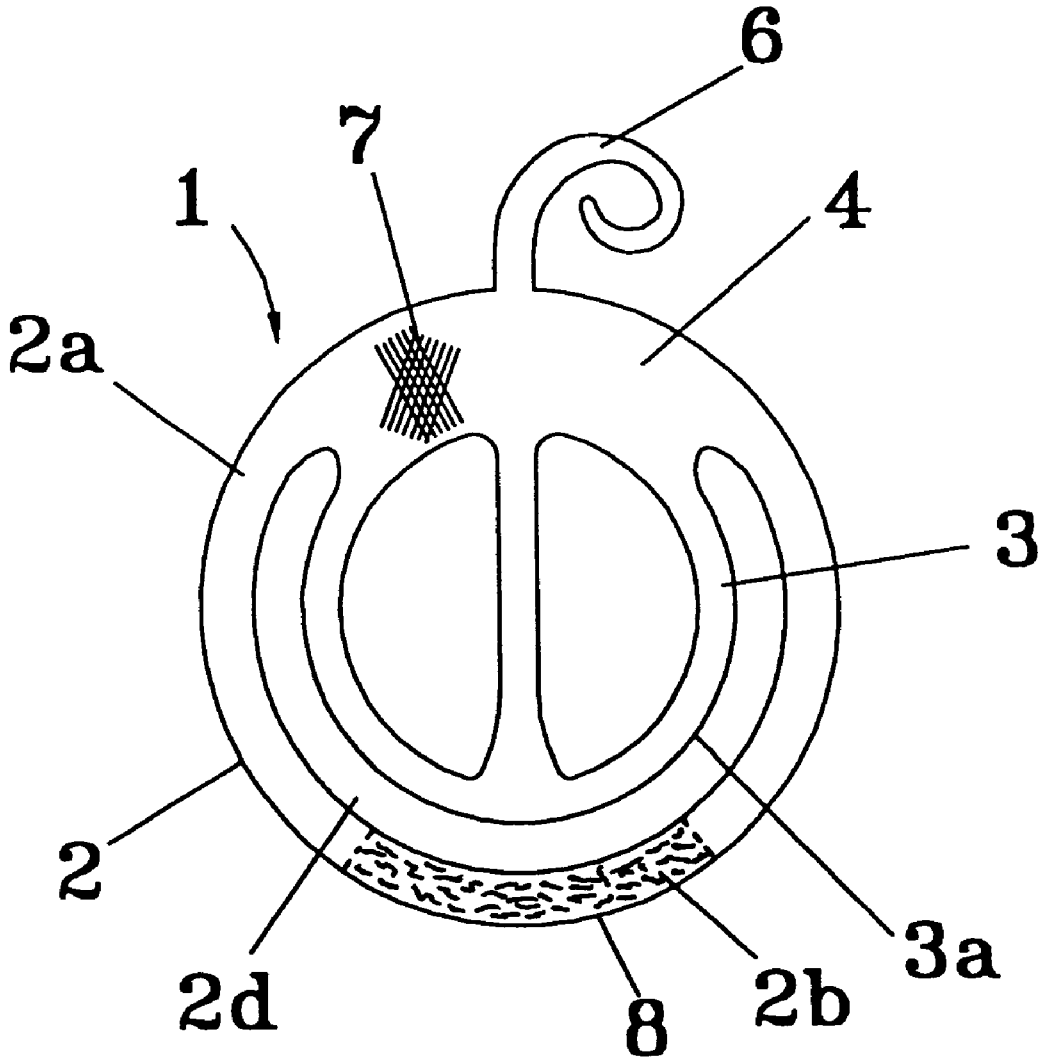
FIG. 1 shows a front view of this embodiment.

One can improve or increase the ease of identification and the possibilities of variation by changing the form of the limiting member (2*a*) of the fixing unit (1) and/or the secondary supporting formed piece (3). It follows that the form of the primary supporting formed piece (2) and the secondary supporting formed piece (3) of the holding device need not be only as shown in FIG. 1 but can also deviate therefrom.

It is essential, however, that the primary supporting formed piece (2) and the secondary supporting formed piece (3) are always interconnected with the aid of the connecting neck (4) such that the necessary prestress arises.

When using the inventive holding device, one fastens the soiled paired garments (5) to the fixing unit (1) of the holding device. For this purpose, one pushes the free flange (3*a*) of the secondary supporting formed piece (3) through the opening (2*d*) of the primary supporting formed piece (2) in such a way that the secondary supporting formed piece (3) is completely on the side of the primary supporting formed piece (2) beside the connecting neck (4). This motion is possible because the distal end of the secondary supporting formed piece (3) is dimensioned so it does not abut the adjacent distal end of piece (2).

One then positions the garment (5) into the free opening defined by the primary supporting formed piece (2) and by the secondary supporting formed piece (3)—and not shown in the drawing and then releases the secondary supporting formed piece (3). The elastic connecting neck (4) thus returns the secondary supporting formed piece (3) into its original position, said piece drawing part of the garments (5) with it. The secondary supporting formed piece (3) draws the garments into the opening (2*d*) of the primary supporting formed piece (2). The garments are prevented from falling out not only by the clamping power but also by the friction-increasing rough areas. More particularly, the garments are clamped between the opposed sides of the arcuate space between pieces (2) and (3). The garments (5) thus are joined together in pairs can be washed out, and hung up on a drying apparatus after cleaning with the aid of the suspension formed piece (6) of the holding device. After drying, one can store the garments (5) by hanging them up with the aid of the suspension formed piece (6) until the time of use.

An identification marking (7) may be formed on a surface of the device.

The inventive holding device is readily applicable for cleaning, drying and storing different garments in a paired state.

What is claimed is:

1. A holding device, said holding device comprising:

a primary support element that has a flat profile, a closed-loop shape that defines an enclosed opening and first and second opposed faces, said primary support element having an inner perimeter that defines the enclosed opening;

a secondary support element that has a flat profile that has an outer perimeter that is smaller in size than the inner perimeter of said primary support element and positioned within a space subtended by the enclosed opening of said primary support element; and a neck formed of flexible material that is integrally attached to said primary support element and said secondary support element for suspending said secondary support element to said primary support element wherein, said neck holds said secondary support element in a static position in which an end of said secondary support element to which said neck is adjacent the first face of said primary support element and an end of said secondary support element distal from said neck is adjacent the second face of said primary support element.

2. The holding device of claim 1, wherein said neck extends outwardly from the first face of said primary support element.

3. The holding device of claim 2, wherein said primary support element and said secondary support element are collectively formed to define a curved space between said support elements.

4. The holding device of claim 1, wherein said neck extends outwardly from the first face of said primary support element along a longitudinal axis and the longitudinal axis of said neck is at an angle to a plane in which said primary support element is oriented, the angle being an acute angle.

5. The holding device of claim 1, wherein said neck extends outwardly from the first face of said primary support element along a longitudinal axis and said secondary support element extends away from said neck in a plane that is angularly offset from the longitudinal axis of said neck, the angle being an acute angle.

6. The holding device of claim 1, further including a support hook mounted to a section of said primary support element from which said neck extends, said support hook being positioned to extend away from said primary support element.

7. The holding device of claim 1, wherein said primary support element is formed with an end distal from said neck and at least one of the primary support element end distal from said neck and the secondary support element end distal from said neck is formed to have a rough outer surface.

8. The holding device of claim 1, wherein said primary support element, said secondary support element and said neck are formed from a single piece of plastic.

9. The holding device of claim 1, wherein said primary support element and said secondary support element are collectively formed to define a curved space between said support elements.

10. A holding device comprising:

a flat, closed loop primary support piece, said primary support piece having first and second opposed faces and having an inner perimeter that defines an enclosed opening;

a neck that extends outwardly from the first face of said primary support piece, said neck being formed from flexible material;

a flat, secondary support piece attached to said neck, said secondary support piece having a curved outer perimeter and at least partially seated in the enclosed opening of said primary support piece wherein, said secondary support piece is suspended from said neck so as to have a static position in which an end of said secondary support piece distal from said neck is adjacent to the second face of said primary support piece and said support pieces are collectively shaped to define a curved gap between the inner perimeter of said primary support piece and the outer perimeter of said secondary support piece.

11. The holding device of claim 10, further including a hook integrally attached to said primary support piece, said hook being attached to said being attached to said primary support piece at a location adjacent to which said neck extends from said primary support piece, said hook being positioned to extend away from said support pieces.

12. The holding device of claim 11, wherein said primary support piece, said secondary support piece, said neck and said hook are formed from a single piece of plastic.

13. The holding device of claim 10, wherein said primary support piece has a circular shape.

14. The holding device of claim 10, wherein said secondary support piece has a circular shape.

15. The holding device of claim 10, wherein said secondary support piece has a closed-loop shape.

16. The holding device of claim 15, wherein said secondary support piece includes a rib that extends from an end of said secondary support piece proximal to said neck to the end of said secondary support piece distal from said neck.

17. A holding device including:

a flat primary support piece, said primary support piece having a closed loop shape, an inner perimeter that defines an enclosed opening and opposed first and second faces wherein, said primary support piece is oriented in a plane;

a flat secondary support piece, said secondary support piece having a closed loop shape and an outer perimeter and;

a flexible neck that extends outwardly from the first face of said primary support piece, wherein said secondary support piece is suspended from said neck so that said secondary support piece is in a plane that intersects the plane in which said primary support piece is oriented and said secondary support piece extends into the enclosed opening of said primary support piece and wherein, said primary support piece and said secondary support piece are collectively dimensioned to define an annular separation between the inner perimeter of said primary support piece and the outer perimeter of said secondary support piece.

18. The holding device of claim 17, wherein said neck extends outwardly from the first face of said primary support piece along a longitudinal axis and the longitudinal axis of said neck is at angle to the plane in which said primary support piece is oriented, the angle being an acute angle.

19. The holding device of claim 17, wherein said neck extends outwardly from the first face of said primary support piece along a longitudinal axis and the plane in which said secondary support piece extends away from said neck is angularly offset from the longitudinal axis of said neck, the angle being an acute angle.

20. The holding device of claim 17, wherein said secondary support piece includes a rib that extends from said neck to an end of said secondary support piece distal from said neck.

* * * * *